US005363970A

United States Patent [19]

Freissle

[11] Patent Number: 5,363,970

[45] Date of Patent: Nov. 15, 1994

[54] SCREENING ARRANGEMENT

[76] Inventor: Manfred F. A. Freissle, 15 Oak Ave., Oakdene, Johannesburg, Transvaal Providence, South Africa

[21] Appl. No.: 111,604

[22] Filed: Aug. 25, 1993

[51] Int. Cl.[5] ..... B07B 1/46

[52] U.S. Cl. ..... 209/399; 209/408

[58] Field of Search ..... 209/395, 399, 403, 408

[56] References Cited

U.S. PATENT DOCUMENTS

| | | | |
|---|---|---|---|
| 3,980,555 | 9/1976 | Freissle | 209/408 |
| 4,265,742 | 5/1981 | Bücker | 209/399 |
| 4,757,664 | 7/1988 | Freissle | 209/399 X |
| 4,882,044 | 11/1989 | Freissle | 209/399 X |

FOREIGN PATENT DOCUMENTS

| | | | |
|---|---|---|---|
| 2706277 | 8/1978 | Germany | 209/399 |
| 7497 | 11/1973 | South Africa | 209/399 |

*Primary Examiner*—D. Glenn Dayoan

*Attorney, Agent, or Firm*—Kerkam, Stowell, Kondracki & Clarke

[57] ABSTRACT

The invention provides for a sieve bend panel of synthetic plastics material which has a screening surface and a plurality of sides and fasteners fast with and projecting from two of its sides. The fasteners are complementary to each other so that fasteners on similar panels placed adjacent to the panel can engage with the fasteners on the two sides to thereby locate the panels side-by-side and to fasten the panels to each other.

9 Claims, 2 Drawing Sheets

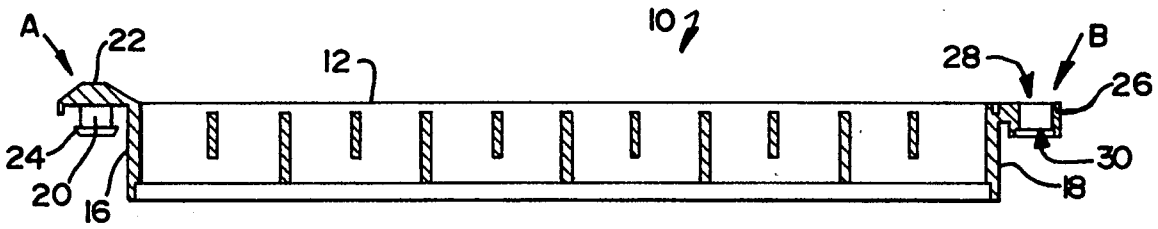
FIG 2
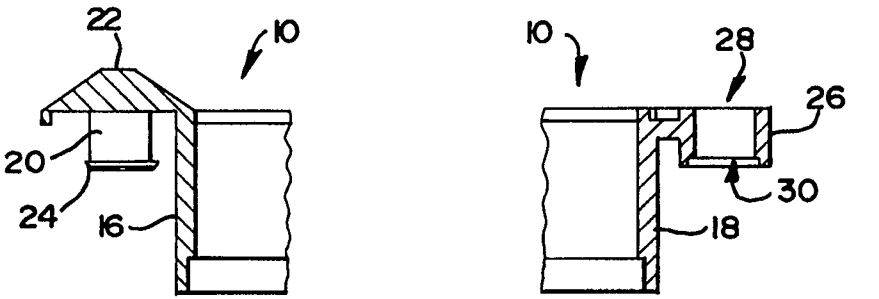
FIG 3
FIG 4
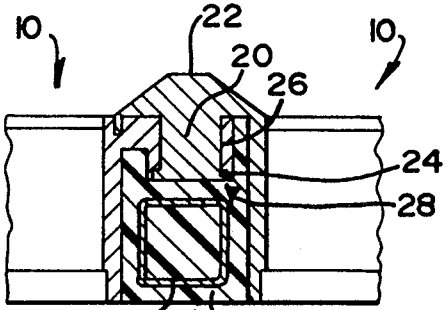
FIG 6
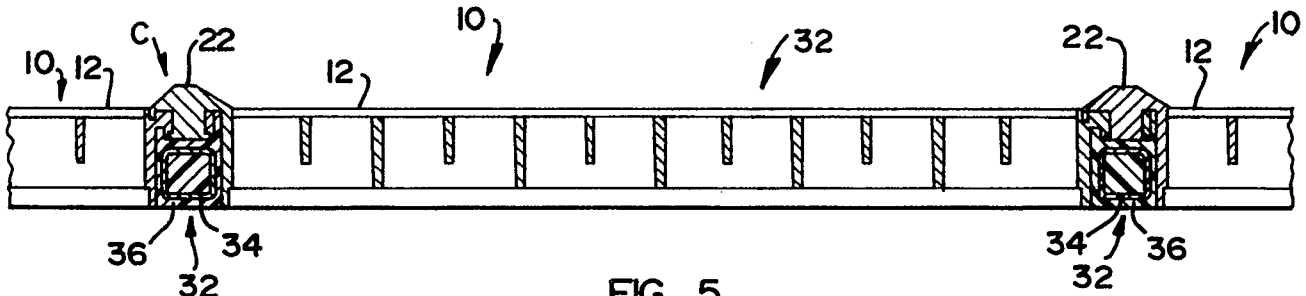
FIG 5

SCREENING ARRANGEMENT

FIELD OF THE INVENTION

This invention relates to a screening arrangement. More particularly the invention relates to a screening arrangement for screening particulate material such as mineral ores. Still more particularly the invention relates to a sieve bend and a sieve bend panel.

BACKGROUND OF THE INVENTION

The applicant is aware of a sieve bend which is formed from numerous small modules each having anchor formations along its periphery. The modules are arranged side-by-side so that grooves or spaces are formed between the adjacent panels with the anchor formations extending into the grooves. The grooves are filled with a bonding material to thereby bond the modules together to form a sieve bend. Stiffening tubes may be provided in the grooves before the bonding agent is cast into the grooves.

A disadvantage of the known arrangement is that it is awkward and time consuming to arrange the modules side-by-side and the method of manufacture therefore does not lend itself readily for mass production. Furthermore, some open screen area is lost due to the joints formed between the modules.

It is an object of the invention to overcome or alleviate at least some of the disadvantages of the known sieve bend.

SUMMARY OF THE INVENTION

According to the invention there is provided a sieve bend panel which is of a synthetic plastics material and which has a screening surface and a plurality of sides and which further has fastening means along two of its sides, the fastening means being complementary to each other so that fastening means on similar panels placed adjacent to the panel can engage with the fastening means on the two sides to thereby locate the panels side-by-side and to fasten the panels to each other.

The fastening means may include interengageable protrusions and recessed formations such as sockets or grooves, the protrusions being provided along one side of the panel and the recessed formations being provided on the other side of the panel so that the protrusions on one panel are engageable with the recessed formations on a similar adjacent panel.

The protrusions may comprise an elongate protrusion along one side of the panel and a complementary elongate groove along the other side of the panel. Alternatively, the protrusions may comprise a plurality of spigot-like protrusions spaced from each other along one side of the panel and spaced complementary socket formations along the other side of the panel. The protrusions may be provided on spaced formations projecting from the periphery of the panel, while the sockets may likewise be provided in spaced formations projecting from the periphery of the panel.

The protrusions may engage the recessed formations in a snap-fit manner. A shoulder may be provided on the protrusion and a recessed groove may be provided in the recessed formation to facilitate the snap-fit fastening.

The synthetic plastics material of the sieve bend panel may be mouldable and may be polyurethane having a Shore hardness of 85 to 90. The screening surface of the sieve bend may comprise a plurality of slotted apertures extending across the panel. The apertures may diverge in the direction of flow of material through the panel to resist blocking or blinding of the apertures.

The fastening means may be releasable.

The invention further extends to a sieve bend formed from a plurality of sieve bend panels in accordance with the invention. The sieve bend may be formed by fastening together a plurality of sieve bend panels in accordance with the invention so that the panels are located side-by-side with each other with grooves formed between the panels where the fastening means on adjacent panels are fastened to each other. The grooves are filled in with a bonding material such as polyurethane. If desired, a stiffening element may be positioned in the groove before the bonding material is filled therein so that the stiffening element is embedded in the bonding material. The stiffening element may be a tube of a square cross-section. The stiffening element may be curved to a desired radius so that the sieve bend thus formed will have a corresponding radius of curvature. The radius may be in the order of 2000 mm.

If desired, a deflecting ridge may be provided along one side of the sieve bend panel so that when a plurality of such panels are arranged side-by-side the deflecting ridge covers the groove formed between adjacent interengaged panels and also covers the bonding material when bonding material is filled into the groove. Thereby the deflecting ridge in use is adapted to deflect particulate material to be screened away from the joint between the panels and onto the screening surfaces of the panels. The deflecting ridge may be integral with the sieve bend panel, for example by being moulded unitary with and in one piece with the panel.

If desired, the sieve bend panels may be releasably inter engageable with each other to permit the panels to be rearranged in the sieve bend for more even wear during use. This may be achieved by having spigot and socket-type locking arrangements on the ends of the stiffening elements.

BRIEF DESCRIPTION OF THE DRAWINGS

The invention is now described with reference with the accompanying drawings in which:

FIG. 2 shows on an enlarged scale a section on line II—II of FIG. 1;

FIG. 3 shows on an enlarged scale detail A of FIG. 2;

FIG. 4 shows on an enlarged scale detail B of FIG. 2;

FIG. 5 shows a fragmentary cross-sectional view of a sieve bend formed from a plurality of sieve bend panels as shown in FIG. 2 fastened to each other in a side-by-side arrangement; and FIG. 6 shows on an enlarged scale the detail C of FIG. 5.

DESCRIPTION OF THE PREFERRED EMBODIMENTS

Figure 1:
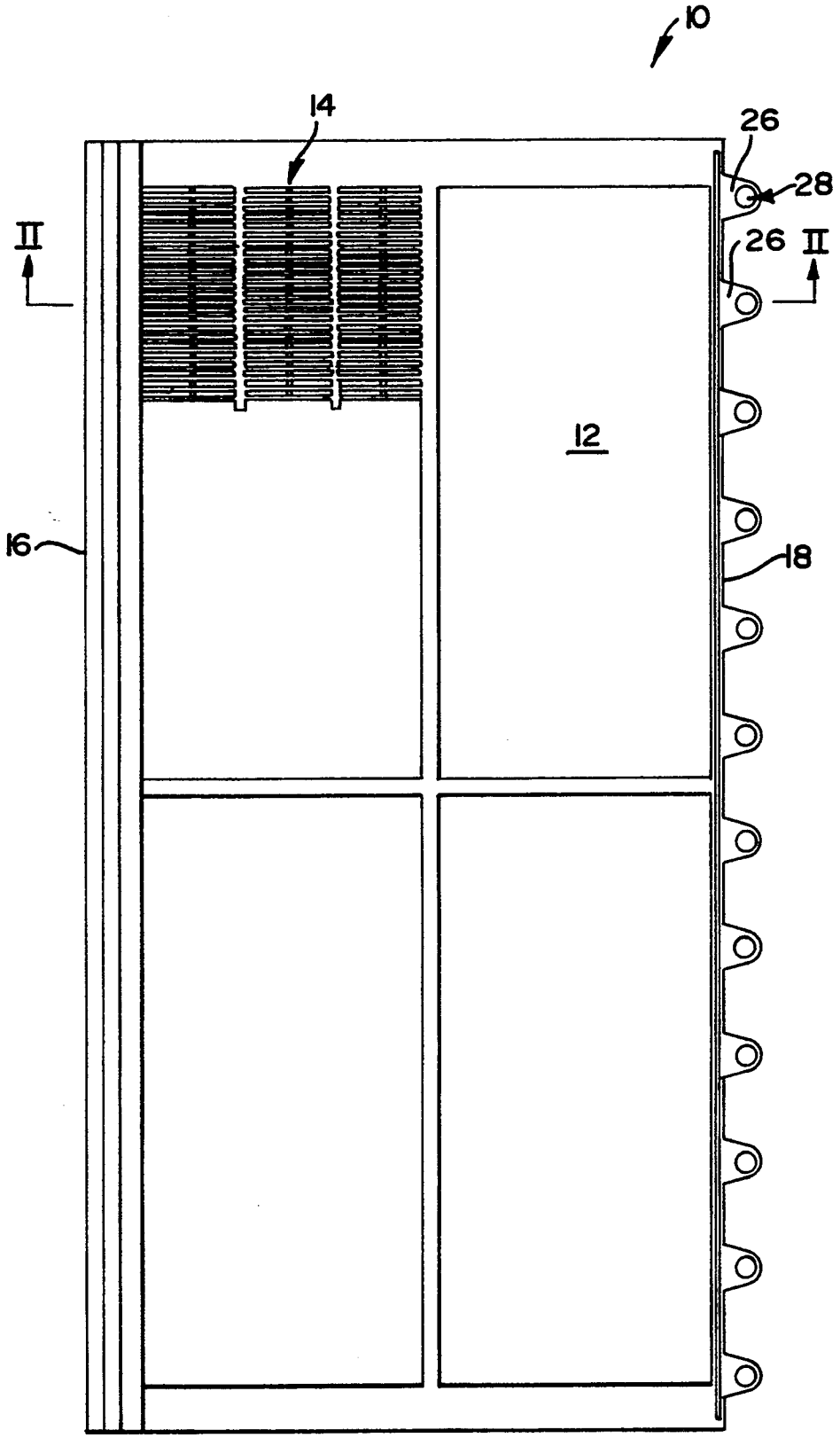
FIG. 1 shows a plan view of a sieve bend panel in accordance with the invention.

Referring to FIGS. 1, 2, 3 and 4 of the drawings, reference numeral 10 indicates in general a sieve bend panel. The panel is of a mouldable synthetic plastics material, more specifically polyurethane of a Shore hardness in the region of 85 to 90. The panel is rectangular in shape and has a screening surface 12 consisting of a plurality of elongate slotted apertures 14 spaced from each other and extending across the panel 10.

Fastening means are provided along the two longitudinal sides 16 and 18 of the panel 10. The fastening means along the side 16 comprise a plurality of spigot-like protrusions 20 projecting downwardly from a deflecting ridge 22 which is provided fast with and unitary with the panel 10 along the side 16. The protrusion 20 has an annular shoulder 24 at its end. Along the side 18 of the panel 10 there are provided a plurality of spaced projections 26 in each of which there is provided a socket 28 with a recessed formation 30 at its bottom end- The protrusions 24 are complementary with the sockets 28 so that the protrusions 20 on a similar adjacent panel can releasably engage and fit into the sockets 28. When so fitted the annular shoulder 24 on the spigot 20 engages the recessed formation 30 in the socket 28 and thereby the spigot 20 snap-fits into the socket 28.

Referring to FIGS. 5 and 6, there is shown a fragmentary cross-sectional view of a sieve bend 32 formed from a plurality of sieve bend panels 10. The sieve bend panels 10 are secured to each other by snap-fitting the protrusions 20 on adjacent panels into the sockets 30 of adjacent panels. Thereby elongate grooves 32 are formed between the adjacent panels 10 with the deflecting ridges 22 covering the grooves. Square metal tubbing 34 is positioned in the grooves 32 and the grooves are filled in with a settable mouldable bonding material 36, for example polyurethane. Thereby a unitary sieve bend 32 is formed. The square tubbing 36 may be curved into a desired radius, for example 2000 mm, so that thereby the sieve bend 32 has a corresponding curvature with a radius of 2000 mm.

The function of the deflecting ridges 22 is to deflect particulate material which is to be screened away from the ridges 22 and onto the screening surfaces 12.

The sieve bend 32 may be used for screening ores, more particularly for dewatering ores such as coal. The elongate screening apertures 14 diverge in the direction of the flow of material through the screening surface 12 to resist the blocking or blinding of the screening surface 12.

The sieve bend 32 has several advantages: its open area or screening surface 12 is impeded only minimally at the joints formed between the panels and this is alleviated by the deflecting ridges 22; the panels 10 are interchangeable; it is a modular system; the sieve bend panels 10 can be injection moulded; the sides of the sieve bend panels form the groove and therefore form the mould for moulding the bonding material in the grooves between the panels, and thereby the necessity for a having a jig for moulding the joints is eliminated; the fastening means 20, 28 provided along the sides of the sieve bend panels 10 facilitate the positioning and securing together of the panels to form the sieve bend panel 32.

What is claimed is:

1. A sieve bend panel which is of a synthetic plastics material and which has a screening surface and a plurality of sides and which further has fastening means along two of its sides, the fastening means being complementary to each other so that fastening means on similar panels placed adjacent to the panel can engage with the fastening means on the two sides to thereby locate the panels side-by-side and to fasten the panels to each other, the fastening means including interengageable protrusions and sockets, the protrusions being provided along one. Side of the panel and the sockets being provided on another side of the panel so that the protrusions on one panel are engageable with the sockets on a similar adjacent panel, the protrusions being provided on spaced formations projecting from the periphery of the panel and the sockets being provided in spaced formations projecting from the periphery of the panel.

2. A sieve bend panel according to claim 1, in which the protrusions comprise a plurality of spigot-shaped protrusions spaced from each other along one side of the panel and engageable with spaced complementary socket along another side of the panel.

3. A sieve bend panel according to claim 1, in which the protrusions engage the sockets in a snap-fit manner.

4. A sieve bend panel as claimed in claim 1, in which the fastening means is releasable.

5. A sieve bend formed from a plurality of sieve bend panels as claimed in claim 1.

6. A sieve bend as claimed in claim 5, which is formed by fastening together a plurality of sieve bend panels so that the panels are located side-by-side with each other with grooves formed between the panels where the fastening means on adjacent panels are fastened to each other and the grooves being filled in with a bonding material.

7. A sieve bend as claimed in claim 6, in which a stiffening element is positioned in the groove before the bonding material is filled therein so that the stiffening element is embedded in the bonding material.

8. A sieve bend as claimed in claim 7, in which the stiffening element is curved to a desired radius so that the sieve bend thus formed has a corresponding radius of curvature.

9. A sieve bend as claimed in claim 5, which includes a deflecting ridge along one side of each sieve bend panel to cover the grooves formed between the adjacent inter-engaged panels and the bonding material in the grooves.

* * * * *

UNITED STATES PATENT AND TRADEMARK OFFICE

CERTIFICATE OF CORRECTION

PATENT NO. : 5,363,970

DATED : November 15, 1994

INVENTOR(S) : Manfred F.A. FREISSLE

It is certified that error appears in the above-identified patent and that said Letters Patent is hereby corrected as shown below:

On the title page, at "[76] Inventor:" in line 3, change "Providence" to -- Province --.

In column 4, line 14 [claim 1, line 11]: change "one. Side" to -- one side --.

In column 4, line 25 [claim 2, line 5]: change "socket" to -- sockets --.

Signed and Sealed this

Seventh Day of February, 1995

*Attest:*

Bruce Lehman

BRUCE LEHMAN

*Attesting Officer*

*Commissioner of Patents and Trademarks*